United States Patent [19]

Wulff

[11] Patent Number: 4,720,614

[45] Date of Patent: Jan. 19, 1988

[54] PUSHBUTTON SWITCH WITH LATCHING ARRANGEMENT

[75] Inventor: Hans-Jürgen Wulff, Hohenwestedt, Fed. Rep. of Germany

[73] Assignee: Licentia Patent-Verwaltungs GmbH, Frankfurt am Main, Fed. Rep. of Germany

[21] Appl. No.: 858,174

[22] Filed: May 1, 1986

[30] Foreign Application Priority Data

May 3, 1985 [DE] Fed. Rep. of Germany ..... 3515895

[51] Int. Cl.[4] ..... H01H 9/20

[52] U.S. Cl. ..... 200/328; 200/325; 200/153 G; 200/5 E

[58] Field of Search ..... 200/153 G, 318, 320, 200/321, 322, 323, 324, 325, 327, 328, DIG. 42, 5 E, 5 EA, 5 EB, 5 C, 70, 71, 72 R, 78, 75, 291, 74; 335/21, 26, 27, 77, 166

[56] References Cited

U.S. PATENT DOCUMENTS

| | | | |
|---|---|---|---|
| 2,550,623 | 4/1951 | Teruzzi | 200/5 E |
| 3,303,295 | 2/1967 | Davis | 200/328 X |
| 3,392,598 | 7/1968 | Waldorf et al. | 200/328 X |
| 3,591,745 | 7/1971 | Puetz | 200/153 J |
| 4,277,666 | 7/1981 | Vignaud | 200/328 |
| 4,544,810 | 10/1985 | Butterworth | 200/5 B |

FOREIGN PATENT DOCUMENTS

| | | | |
|---|---|---|---|
| 699321 | 10/1940 | Fed. Rep. of Germany | 200/328 |
| 17151 | 7/1956 | Fed. Rep. of Germany | 200/328 |
| 1903579 | 8/1964 | Fed. Rep. of Germany . | |
| 2705330 | 10/1983 | Fed. Rep. of Germany . | |
| 3213493 | 10/1983 | Fed. Rep. of Germany . | |
| 364313 | 10/1938 | Italy | 200/328 |

*Primary Examiner*—Henry J. Recla
*Assistant Examiner*—Ernest G. Cusick
*Attorney, Agent, or Firm*—Spencer & Frank

[57] ABSTRACT

A motor protection electric switch, and the like, in which contacts are opened and closed by means of a switch latch equipped with an "on" button and an "off" button, with the different positions of the "on" button indicating the switching state of the contacts. A two-armed blocking lever is rotatably mounted on a latch housing of the switch, and disposed between the contact member carrier and the "on" button. One arm of the lever is latched with the "on" button while the other arm thereof is supported at the contact member carrier as long as the contacts are not opened sufficiently far to open a circuit through the contacts of the switch.

5 Claims, 5 Drawing Figures

PUSHBUTTON SWITCH WITH LATCHING ARRANGEMENT

BACKGROUND OF THE INVENTION

The present invention relates to an electrical switch. More specifically, the invention is concerned with a reliable display of switching position, even in the case of malfunction, of an electrical switch, particularly a motor protection switch, in which actuation of the movable contacts is effected by a switch latch operated by an "on" button and an "off" button and in which the "on" button is intended to display the switch position.

In previously employed motor protection switches, an unequivocal "off" position was not always assured if, for example, the contacts were welded together due to overheating from excessive current, and the like. If in these devices the motor switch is turned off but the contacts are welded together, the "on" button usually moves outwardly a sufficient distance such that an error can be noted only by a very close inspection.

German Printed Application DE-PS No. 2,705,330 discloses an electrical switch in which a rocker is disposed outside the side plates of the switch latch. This rocker is arranged to block the "on" button of the switch until a drive lever which actuates the contact member carrier has moved to such an extent that a change in position of the angular lever can take place and the rocker releases the "on" button of the switch.

German Laid-Open Application DE-OS No. 3,213,493 discloses an electrical switch in which an "on" button is latched in a similar manner within the side plates of the switch latch by use of a blocking slide actuated by a compression spring. When deactivating the switch, the drive lever of the contact member carrier actuates the blocking slide. After a certain path length, the latter releases the "on" button.

In both embodiments, the blocking member is released by a drive lever whose path is much shorter at the point of engagement than the path of the movable contacts. This results in a great susceptibility to tolerances.

SUMMARY OF THE INVENTION

It is an object of the present invention to increase reliability of an electric switch by use of a simple blocking member.

This and other objects are achieved according to the present invention by a switch having a resilient blocking member which releases an "on" button only after movable contacts of the switch have traveled a sufficiently long separating path to assure separation.

The invention will be explained in greater detail below with the aid of the drawings.

DESCRIPTION OF THE PREFERRED EMBODIMENTS

Figure 1:
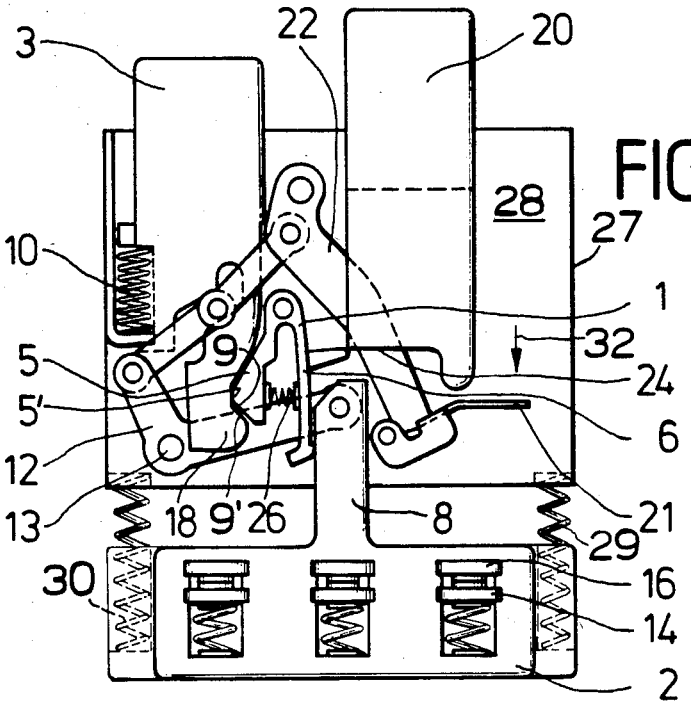
FIG. 1 is a diagrammatic, side elevational view showing a switch latch according to the present invention arranged with a contact system and blocking lever thereof in the "on" position.

FIGS. 1 through 5 of the drawings illustrate diagrammatically a preferred embodiment of the present invention, including a blocking lever 1 according to the invention. Blocking lever 1 preferably is provided in the from of an elastic element, such as a molded member made in a conventional manner from a thermoplastic material, and is rotatably mounted on a side plate 28 of a latch housing 27 at a bearing point 4 between an "on" activator or push button 3 and a contact member carrier 2. The construction of latch housing 27 is of a conventional nature, and will not be described in greater detail herein. Blocking lever 1 has two arms, designated 5 and 6. Arm 5 has a portion 5' forming a detent of such configuration that in the "on" position of the "on" button 3, portion 5' slides into a recess 7 provided in a lower, or inner, portion of button 3 (see FIG. 1). Portion 5' and recess 7' have faces 9, 9', respectively, which are disposed at a predetermined angle a (FIG. 5) relative to a plane perpendicular to the path of movement of button 3 and which, in conjunction with a return spring 10, exert a torque on blocking lever 1 in a counterclockwise direction, i.e. in the direction in which detent 5' would release button 3. The second arm 6 is actuated by a projecting drive member 8 of contact member carrier 2 and has such dimensions that the force generated by elastic deformation of arm 6 when engaged by member 8 exerts a torque on arm 5 in the direction to maintain detent 5' in recess 7, i.e. in a blocking direction. This torque is much greater than the moment acting in the counterclockwise, or release, direction. An increase of the blocking moment can be realized by use of a compression spring 26 (FIG. 1), or other resilient element such as a block of rubber, disposed between arm 5 and arm 6.

The illustrated embodiment further includes a two-armed lever, or rocker, 12 mounted on a pivot bearing 13 that is fixed to side plate 28. The free end of one arm of lever 12 is articulated to drive member 8. The free end of the other arm of lever 12 is connected via an articulated knee joint 11 to a latch lever 22 the upper end of which is mounted on a pivot bearing fixed to side plate 28. Knee joint 11 is composed of two links pivotally connected together by a pin which also engages, to function as a cam follower, in a camming groove in button 3. The free end of latch lever 22 cooperates with a lever 21 which is mounted on a pivot bearing fixed to side plate 28. Lever 21 is pivotal between a latching position, shown in FIGS. 1 and 2, in which it retains the free end of latch lever 22, and a release position, shown in FIG. 5, in which it releases lever 22.

Figure 2:
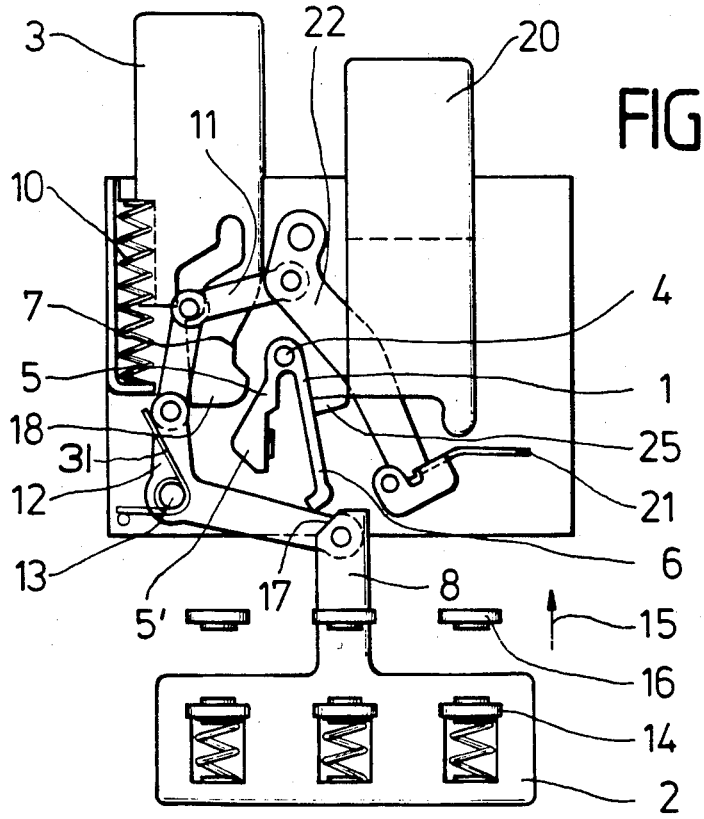
FIG. 2 is a diagrammatic, side elevational view, similar to FIG. 1, but with the contact system and blocking lever thereof shown in the "off" position.
Figure 5:
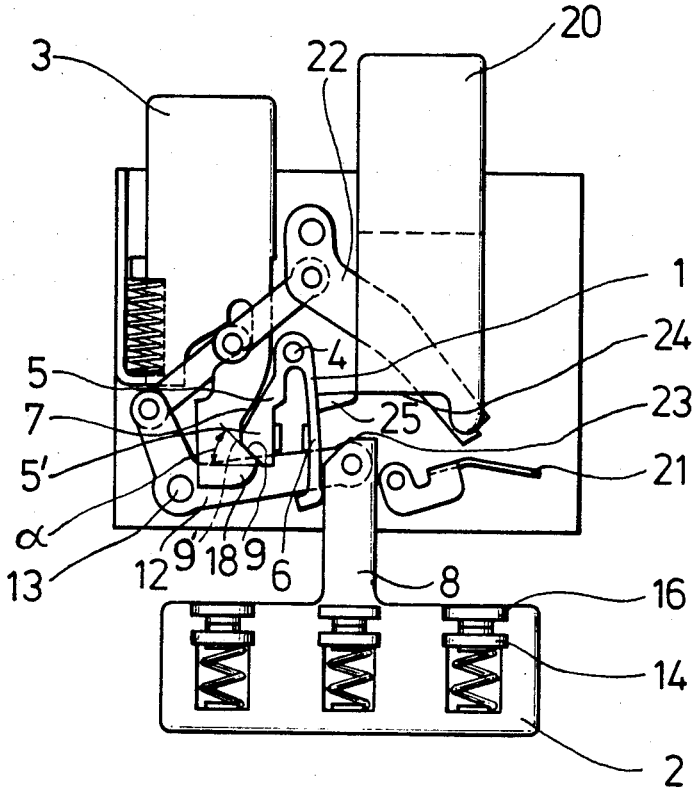
FIG. 5 is a diagrammatic, side elevational view, similar to FIGS. 1 and 2, but showing a switch according to the present invention with contact system and blocking lever thereof stuck in the "on" position due to welded together contacts.

As is apparent from the drawings, parts 11, 12, 21 and 22, and the camming groove in button 3, cooperate to allow carrier 2 to move to the off, or opened contact, position, shown in FIG. 2, if button 3 is in its off position, also shown in FIG. 2, or if lever 21 is in its release position, shown in FIG. 5.

As shown in FIG. 2, movement of button 3 to its off position brings lever 22 to the position in which it can be retained by lever 21.

Arm 6 has a catch 25 which cooperates with latch lever 22 and this, in conjunction with the contour of a projection portion 18 of the "on" button 3, constricts the position of blocking lever 1 in the "off" state of the switch in such a manner that subsequent actuation of arm 6 by drive member 8 is assured. See FIG. 2.

Figure 3:
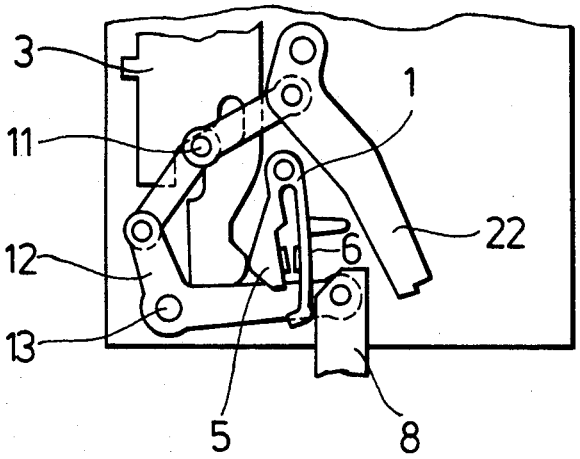
FIG. 3 is a fragmentary, diagrammatic, side elevational view showing a portion of the switch latch of FIG. 1 and 2, but with a blocking lever positioned at a particular point during a switch turn-on process.

Actuation of "on" button 3 causes the knee joint 11 to rotate rocker 12 about fulcrum 13 and, thus, contact member carrier 2 and the movable contact bridges 14 of carrier 2 are moved in the direction of arrow 15 until contact bridges 14 establish contact with fixed contacts 16 of the switch. During this turn-on process, drive member 8 of contact member carrier 2 biases arm 6 of the elastic blocking lever 1. This is accomplished in the illustrated embodiment by a sloping face 17 provided on member 8. Simultaneously, arm 5 is actuated by portion 18 of "on" button 3 and is compressed into an intermediate position as shown in FIG. 3. During further actuation of "on" button 3, arm 5 springs into recess 7 of "on" button 3, as seen in FIG. 1. The end position of "on" button 3 indicates the switch position "turned on".

Depression of "off" actuator or button 20, or actuation of a suitable trigger (not shown) on lever 21, causes lever 21 to be rotated until latch lever 22 is released. Thus, contact member carrier 2 and contact bridges 14 carried thereon are able to move back into the "off" position shown in FIG. 2.

The contact member carrier 2 will be moved into the "off" position by springs 29, 30. These springs may be compression springs which are housed in chambers on both sides of the contact member carrier 2. Also a turning spring 31 upon the fulcrum 13 can be used which acts directly upon the rocker 12.

The trigger can be placed above or below of the switch latch and work upon a common tripping axis. In the case of an overload this tripping axis executes a triggering movement in the direction of arrow 32 upon lever 21 and effects the release of latch lever 22.

Figure 4:
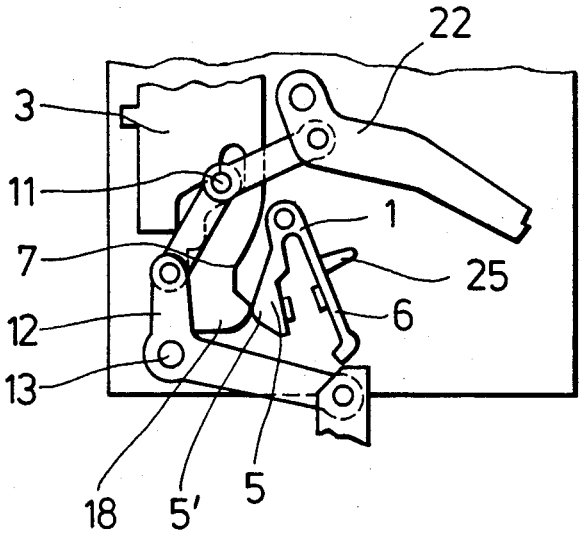
FIG. 4 is a fragmentary, diagrammatic, side elevational view similar to FIG. 3, but showing a switch according to the invention after a turn-off movement with the "on" button of the switch having traversed only part of a path thereof.

After the contact opening force has become sufficiently large to interrupt an electrical circuit between contacts 14, 16, arm 6 of blocking lever 1 is released by drive member 8 of contact member carrier 2. A torque generated by return pressure spring 10 of "on" button 3 via the face provided at an angle $\alpha$ (FIG. 5) causes blocking lever 1 to rotate about point 4 so that portion 5' of arm 5 no longer exerts a restraining force on button 3 and the latter can move to its off position (FIG. 4). The latter is returned by compression spring 10 into the position seen in FIG. 2, which indicates a "turned off" mode for the switch.

If during this turning-off operation, however, the contacts 14, 16 do not open, because the fixed and the movable contacts 14, 16 are welded together for example, or if due to some other malfunction contact member carrier 2 has not opened far enough to interrupt a circuit through the contacts 14, 16, arm 6 will not be released by drive member 8. This situation is shown in FIG. 5. The torque acting on arm 5 in the blocking direction, due to the elastic deformation of detent lever 1, is greater than the torque imposed on arm 5 by the return spring 10 in the release direction. "On" button 3 is retained in the position indicating a "turned on" mode. After unlatching, further actuation of the "off" button 20 enables a force to be applied directly to the contact member carrier 2, in a manner not shown, via lower, or inner, face 24 of "off" button 20 and parallel adjacent face 23 of the contact member carrier 2, sufficient to open the contacts 14, 16. Here again, the position indicating a "turned off" mode is displayed only after the opening has become sufficiently large to interrupt an electrical circuit between the contacts 14, 16.

It will be understood that the above description of the present invention is susceptible to various modifications, changes and adaptations, and the same are intended to be comprehended within the meaning and range of equivalents of the appended claims.

What is claimed is:

1. An electrical switch comprising:

first and second electrical contacts;

a movable contact carrier supporting said first contact and movable between an on state in which said first contact conductively contacts said second contact and an off state in which said first contact is spaced from said second contact;

a switching button movable between an on position and an off position;

means connected between said button and said carrier for causing said carrier to move into its on state in response to movement of said button to its on position;

a pivotally mounted two-armed blocking lever interposed between said button and said carrier, said lever having a first arm formed to engage said button when said button is in its on position, and a second arm engaged by said carrier as long as said carrier is not in its off state for causing said first arm to retain said button in its on position as long as said second arm is engaged by said carrier and for permitting said button to move to its off position when said carrier is in its off state, at least said second arm of said lever being elastically deformable, whereby the position of said button is indicative of the state of said carrier; and a spring biassing said button into its off position, wherein said button and said first arm of said lever have latch faces placed at a predetermined angle and arranged for cooperatively engaging so that a force exerted by said spring causes said button to exert on said lever a first torque in a direction to urge said latch face of said first arm of said lever out of engagement with said latch face of said button.

2. A switch as defined in claim 1 wherein engagement of said second arm of said lever by said carrier effects bending of said second arm in a direction to exert a second torque on said first arm of said lever, which second torque is in a direction to press said latching faces together and is larger than said first torque.

3. A switch as defined in claim 2 further comprising a compression spring interposed between said lever arms for increasing the magnitude of said second torque.

4. A switch as defined in claim 1 further comprising a catch element carried by said second arm of said lever and wherein said button is provided with a projecting portion directed toward said first arm of said lever, and said catch element and said projecting portion are operative to limit the mobility of said lever to assure reliable operation thereof.

5. A switch as defined in claim 1, wherein said lever is a molded member made from a thermoplastic synthetic material.

* * * * *